United States Patent [19]

Justus

[11] 4,141,789

[45] Feb. 27, 1979

[54] HEADBOX HAVING PIVOTED BRIDGING COVER

[75] Inventor: Edgar J. Justus, Beloit, Wis.

[73] Assignee: Beloit Corporation, Beloit, Wis.

[21] Appl. No.: 853,901

[22] Filed: Nov. 22, 1977

[51] Int. Cl.[2] ..... D21F 1/02

[52] U.S. Cl. ..... 162/272; 162/336; 162/337; 162/343; 162/347

[58] Field of Search ..... 162/264, 272, 317, 336, 162/343, 347, 337

[56] References Cited

U.S. PATENT DOCUMENTS

| | | | |
|---|---|---|---|
| 3,328,236 | 6/1967 | Burgess, Jr. et al. | 162/343 X |
| 3,528,882 | 9/1970 | Notbohm | 162/343 X |
| 3,565,758 | 2/1971 | Higgins et al. | 162/336 |
| 3,839,149 | 10/1974 | Justus et al. | 162/343 X |
| 3,865,687 | 2/1975 | Rajala | 162/264 X |
| 3,943,035 | 3/1976 | Stotz et al. | 162/272 |

*Primary Examiner*—Richard V. Fisher

*Attorney, Agent, or Firm*—Hill, Gross, Simpson, Van Santen, Steadman, Chiara & Simpson

[57] ABSTRACT

A headbox for a paper making machine having a slice chamber with a vertical tube bank supplying the slice chamber and a distributor chamber behind the tube chamber tapering from a larger size to one side of the machine to a smaller size at the other side of the machine with the lower floor of the header chamber sloping upwardly and a pivotal cover extending over the tube bank and header chamber openable for access to the tube bank and header chamber.

8 Claims, 2 Drawing Figures

Figures 1, 2:
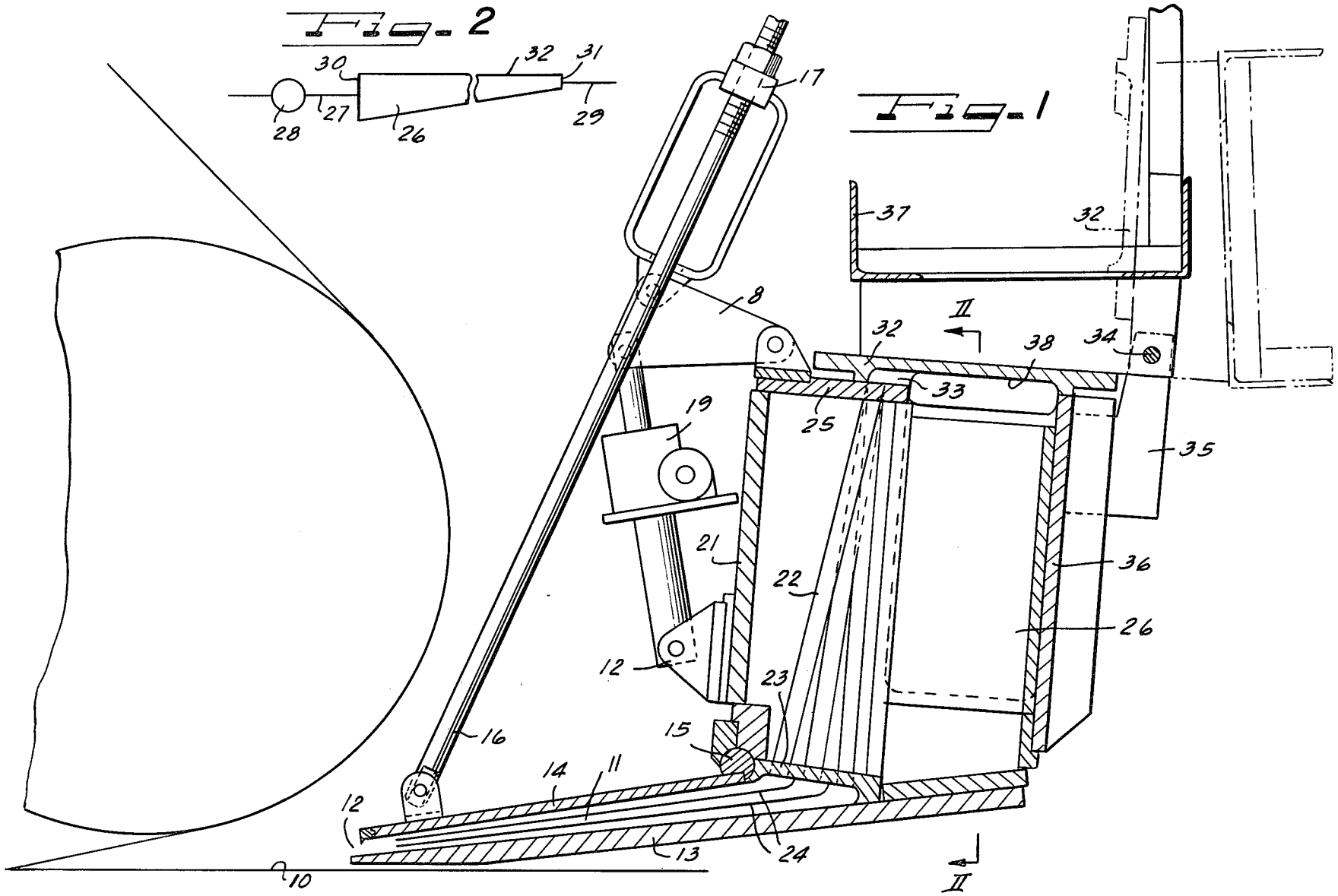

8
10
11
12
13
14
15
16
17
19
21
22
23
24
25
26
27
28
29
30
31
32
33
34
35
36
37
38
II

HEADBOX HAVING PIVOTED BRIDGING COVER

BACKGROUND OF THE INVENTION

The present invention relates to improvements in paper making machines, and more particularly to an improved headbox for supplying paper stock from a supply conduit from a fan pump and distributing the stock across the width of a machine to a slice chamber.

In the formation of a traveling fibrous web by depositing fibers in a slurry onto a porous forming surface, the stock is distributed onto the surface from a slice chamber through a slice opening. In order to maintain uniform velocity of flow and fine scale turbulence in the stock, it is fed into the slice chamber through a plurality of tubes forming a tube bank with the tubes essentially uniformly distributed across the machine. In one form of such construction for compactness, the unit is arranged so that the distributor tube bank feeds downwardly directly into the slice chamber and the tube bank is conventionally supplied with stock from a header extending across the machine positioned above the tube bank. To maintain a uniform velocity of flow of stock across the header, the stock is supplied to the header from a conduit leading from a fan pump at one side of the machine and the header tapers to a small end at the other side of the machine and excess stock may flow through a recirculating line leading off from the small end of the header. In this arrangement in order to maintain the distributor tubes at a uniform length, the top wall of the header chamber slopes in a downward direction. The downwardly sloping wall of the header chamber tends to cause air bubbles to form and tends to cause the fibers of the stock to gather along a wall. Also, the fibers will tend to conglomerate and nonuniform flow will result so that the stock gets dirty as these conglomerates of fibers are released and flow further along the header or down through the distributor tubes. Such dirty stock or conglomeration of fibers will cause marked defects in the resultant paper. That is, in order to produce uniform paper, the stock must continue to flow uniformly at all locations and cannot slow down, the fibers cannot conglomerate and air bubbles cannot be permitted to form.

A feature of the present invention is to provide an improved headbox arrangement where the advantages of a compact tube bank which leads immediately directly down into the slice chamber are retained, yet the disadvantages of stock defects and gathering air bubbles are avoided.

It is accordingly an object of the present invention to provide an improved headbox construction with a tube bank leading downwardly into a slice chamber and a header chamber for supplying stock to the tube bank wherein the header chamber does not have any downwardly sloping surface.

A still further object of the invention is to provide an improved headbox construction of the type described with improved clean-out features wherein easy and immediate access to the header chamber and tube bank is readily afforded.

A still further object of the invention is to provide an improved headbox construction with a unique cover arrangement which forms a chamber wall for the distributor tube bank and the header chamber.

Other objects, advantages and features, as well as equivalent structures which are intended to be covered herein will become more apparent with the teaching of the principles of the present invention in connection with the disclosure of the preferred embodiment thereof in the specification, claims, and drawings, in which:

DRAWINGS

FIG. 1 is a side elevational view of a headbox in vertical section showing the internal construction of a headbox constructed and operating in accordance with the principles of the present invention; and FIG. 2 is a reduced rear elevational view taken substantially along line II—II of FIG. 1.

DESCRIPTION

As illustrated in FIG. 1, a traveling fibrous web is formed by dewatering a stock slurry deposited onto a forming surface 10 such as a fourdrinier wire. The stock flows through a slice chamber 11 out through a slice opening 12 onto the wire 10.

The slice chamber is formed by a slice chamber floor 13 and a movable slice chamber roof 14. The roof of the slice chamber is pivoted at 15 onto headbox framework. For pivoting the slice chamber roof up and down to change the size of the opening 12, a connecting rod 16 pivotally connects to the forward edge of the roof 14 and is moved up and down by an adjustment nut mechanism 17 for small adjustments. For major adjustment of the slice opening, a Duff Norton jack 19 is mounted on a bracket **12*a* on the headbox and connects to an arm 8 which supports the small adjustment mechanism 17. Within the slice chamber are a plurality of flexible trailing elements 24 anchored at their upstream end to a plate 23 and trailing at their downstream ends receiving flow from distributor tubes of a tube bank 22**.

The headbox framework includes a vertical wall 21 which provides a mount for the bracket 12 and the arm 8 for the slice roof adjustment mechanism.

A fiber stock slurry is fed down into the slice chamber 11 through a distributor chamber means, such as preferably the tube bank 22 having a plurality of vertical distributor tubes relatively uniformly distributed across the width of the machine. These tubes are suitably supported to extend through holes in the plate 23 at their lower ends leading into the slice chamber and in a plate 25 at their upper ends, which plate 25 has openings for the stock to flow in the upper ends of the distributor tubes.

For supplying stock to the upper ends of the distributor tubes, a header chamber 26 is positioned immediately behind the tube bank 22. The header chamber extends along the full width of the machine, as generally indicated in FIG. 2, and is tapered from a larger end 30 to a smaller end 31 for the purpose of insuring uniform flow velocity across the header chamber 26, as the stock flows out of the header chamber up into the upper ends of the tube bank across the width of the machine.

For supplying stock to the header chamber, a stock supply conduit 27 connects to the larger end 30 supplied by fan pump 28. A recirculation line 29 connects to the smaller end for carrying away excess stock which does not flow into the distributor tubes.

The stock flows uniformly out of the top of the header chamber across a space indicated at 33 provided beneath a pivotal wall or bridging cover 32 which extends over the top of a header chamber and over the top of the distributor tubes thereby bridging the space over the header chamber and the entry to the distributor tubes. The cover 32 will have suitable seals around its edge and have dogs or fasteners with a gasket arrangement to insure that the stock which is under pressure does not leak out around the edge of the cover 32. The cover will have a lip to seal at its side edges and to seal at its front edge against the upper wall 25 of the tube bank and to seal against the rear wall 36 of the header chamber.

A unique and important feature is the structural and functional arrangement of the cover 32 which permits to be moved from a closed position, shown in a solid line position of FIG. 1 to an open position, shown in the dotted line position of FIG. 1 wherein full access is afforded to the top of the header chamber and to the tube bank for servicing and cleaning. The undersurface of the cover 32, shown at 38, tapers or slopes in an upward direction for smooth flow of the stock and to prevent the collection of bubbles and accumulation of fibers. A strengthening framework 37 is positioned above the cover and rigidly secured thereto.

A preferred mount for the cover provides a pivotal support at its rear edge at 34 where it is supported on a bracket 35 mounted to the wall 36 of the header chamber. This permits pivotal movement of the cover between its solid and dotted line position of FIG. 1. The cover may be moved manually or suitable power mechanism may be provided for this movement of the cover between its closed position and its open servicing position.

Thus, it will be seen that I have provided an improved headbox construction which provides a very compact unit requiring a minimum of space in the mill. The compact space promotes ease of cleaning and servicing, and the arrangement attains the objectives and advantages above set forth.

I claim as my invention:

1. A headbox for a paper making machine comprising in combination:

a slice chamber having a slice opening for distributing a fibrous stock onto a traveling forming surface;

a distributor chamber means connected to the slice chamber for stock to flow into an upper portion and out of a lower portion thereof into said slice chamber;

a header chamber connected to said distributor chamber means along the width thereof with a lower wall tapering upwardly to decrease the depth of the header chamber along its width for uniform lateral supply flow along the width of the header chamber;

a paper stock supply conduit for supplying pressurized stock to the larger end of said header chamber;

a horizontal bridging cover extending over the top of said header chamber and said distributor chamber so that stock flows across beneath said bridging cover from the header chamber to the distributor chamber;

and means for accommodating movement of said cover between a first position wherein said cover extends horizontally over said chambers and a second position where access to said chambers is afforded.

2. A headbox for a paper making machine constructed in accordance with claim 1:

wherein said distributor chamber means embodies a distributor tube bank with a plurality of uniformly distributed substantially vertical tubes communicating between said header chamber and said slice chamber.

3. A headbox for a paper making machine constructed in accordance with claim 1:

wherein said cover is pivotally supported at its rear edge over said header chamber so that the wall edge over the distributor chamber means pivots away from the distributor to a position over the header chamber.

4. A headbox for a paper making machine constructed in accordance with claim 1:

wherein said wall slopes in an upward direction from over the header chamber to over the distributor chamber means.

5. A headbox for a paper making machine constructed in accordance with claim 4:

wherein said distributor chamber means includes a plurality of substantially vertical uniformly horizontally distributed distributor tubes leading downwardly from beneath said wall into the slice chamber.

6. A headbox for a paper making machine constructed in accordance with claim 1:

wherein said header chamber diminishes uniformly in cross sectional size across the width of the machine and said supply conduit connects to the larger end and a recirculation conduit connects to the smaller end for continuing flow through the header chamber.

7. A headbox for a paper making machine constructed in accordance with claim 1:

including a plurality of flexible trailing elements in the slice chamber anchored to a member within the slice chamber at their upstream ends and trailing at their downstream ends receiving flow from the distributor chamber means.

8. A headbox for a paper making machine comprising in combination:

a tapered slice chamber having a slice opening for distributing a fibrous stock onto a traveling forming surface and having a movable slice chamber top wall pivoted at the upstream edge thereof;

power means for pivoting the slice chamber wall to change the size of the slice opening;

a movable forming surface positioned beneath the slice opening for forming a web thereon from stock issuing from the slice opening;

a vertical distributor tube bank leading into the upstream end of the slice chamber;

a plurality of flexible trailing elements anchored to a member within the chamber at their upstream ends receiving flow from the tube bank and extending downstream within the slice chamber;

a header chamber extending across the width of the slice chamber and located behind the tube bank and tapering to reduce in size from a delivering end to a discharge end;

a paper stock supply conduit connected to the delivery end;

a recirculation conduit connected to receive stock from the smaller end of the header chamber;

a pivotal headbox cover extending over the top of the header chamber of the tube bank and affording communicating flow therebeneath from the header chamber to the tube bank;

and a pivotal mount for the cover on the header chamber accommodating movement from a closed position over the tube bank and over the header chamber to an open position extending upwardly from the header chamber and affording vertical access to the tube bank and header chamber.

* * * * *